United States Patent [19]

Werding

[11] Patent Number: 4,969,577

[45] Date of Patent: Nov. 13, 1990

[54] APPARATUS TO PROVIDE FOR THE STORAGE AND THE CONTROLLED DELIVERY OF PRODUCTS THAT ARE UNDER PRESSURE

[76] Inventor: Winfried J. Werding, 77, avenue du General Guisan, CH-1009 Pully, Switzerland

[21] Appl. No.: 342,536

[22] PCT Filed: Jun. 27, 1988

[86] PCT No.: PCT/CH88/00115

§ 371 Date: Feb. 27, 1989

§ 102(e) Date: Feb. 27, 1989

[87] PCT Pub. No.: WO88/10221

PCT Pub. Date: Dec. 29, 1988

[30] Foreign Application Priority Data

Jun. 26, 1987 [CH] Switzerland ..... 2429/87
Oct. 26, 1988 [CH] Switzerland ..... 4180/87

[51] Int. Cl.[5] ..... B65D 35/22

[52] U.S. Cl. ..... 222/94; 222/105; 222/386.5; 222/402.16; 222/402.24; 141/3

[58] Field of Search ..... 222/94, 95, 105, 402.1, 222/402.16, 402.24, 518, 386.5, 545; 141/3, 20

[56] References Cited

U.S. PATENT DOCUMENTS 3,662,926 5/1972 Umstead ..... 222/95
3,731,854 5/1973 Casey ..... 222/386.5
3,851,799 12/1974 Paoletti ..... 222/402.16 X
3,907,169 9/1975 Gortz ..... 222/95
4,045,860 9/1977 Winckler ..... 222/94 X
4,189,069 2/1980 Stoody ..... 222/94 X
4,216,884 8/1980 Giuffredi ..... 222/402.16
4,266,941 5/1981 Sullivan ..... 222/94 X
4,548,606 10/1985 Larkin ..... 222/94 X

FOREIGN PATENT DOCUMENTS 2906308 8/1980 Fed. Rep. of Germany .
6810581 1/1970 Netherlands .

*Primary Examiner*—Andres Kashnikow
*Assistant Examiner*—Gregory L. Huson
*Attorney, Agent, or Firm*—Sherman and Shalloway

[57] ABSTRACT

A flexible bag (4) that is filled with a product (5) is accommodated in a rigid container (1). The bag is welded to a valve unit A, which provides an absolute seal for the container (1) by means an annular membrane (17) that is pressed into the neck of the container (19) and a double annular rib (19) that is pressed into an annular groove (20) as well as by the welding (23) of a closing sleeve (22) to the container (1). The product (5) is forced into the bag (4) and compressed air is forced through a drilled hole (11) of a valve plate (7) into the container (1) by downward pressure on a valve plunger (8). The valve unit (A) closes the bag (4) a sealing washer (12), working as a non-return valve, seals the container (1) and avoids any loss of pressure, whereafter, when the valve unit is open, the container pressure compresses the bag (4) so that the product is dispensed through a spray head (14).

17 Claims, 9 Drawing Sheets

30
31
10
32
27
28
29
8
22
25
47
47
7
18
12
11
13
17
23
9
21
16
16
20
6
15
15
21
23
16
16
19

Fig. 3
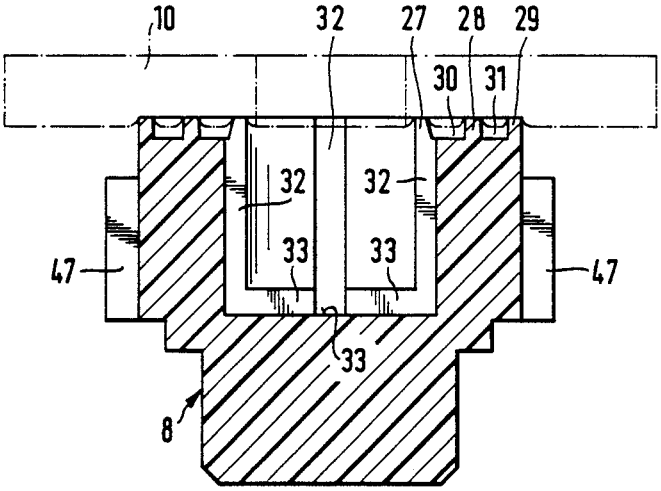
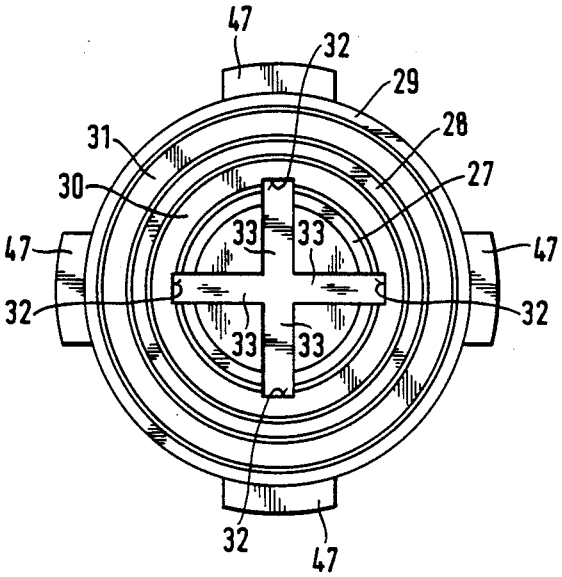
Fig. 4

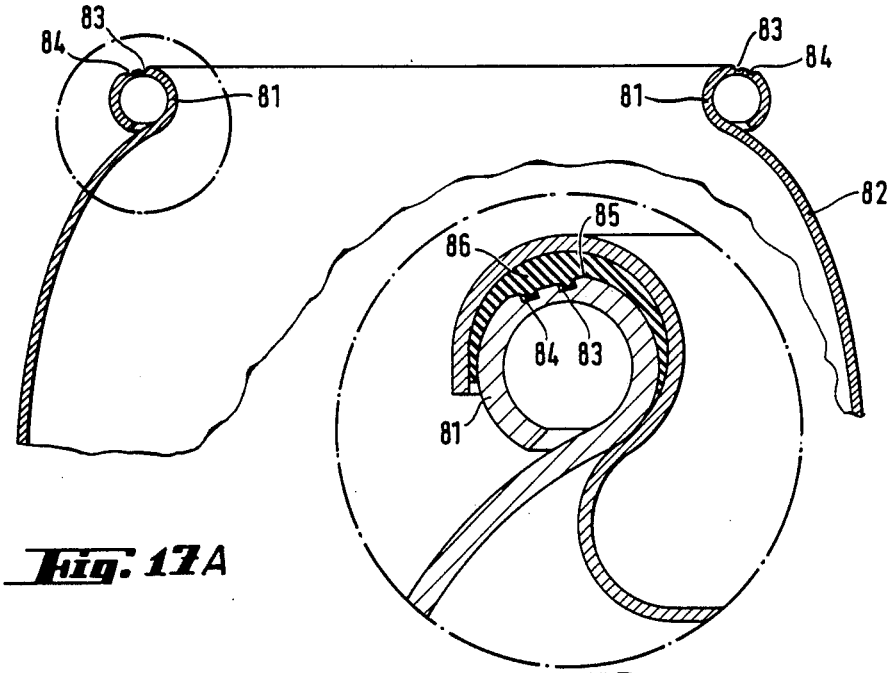
Fig. 17A
Fig. 17B
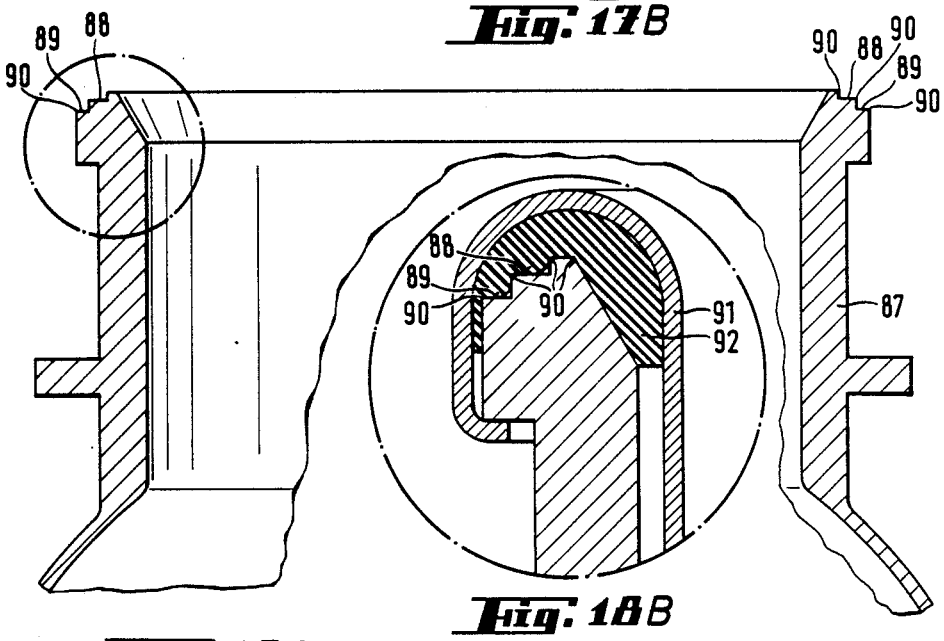
Fig. 18B
Fig. 18A

APPARATUS TO PROVIDE FOR THE STORAGE AND THE CONTROLLED DELIVERY OF PRODUCTS THAT ARE UNDER PRESSURE

BACKGROUND OF THE INVENTION

1. Field of the Invention

The present invention relates to an apparatus for the storage and the controlled deliver of products under pressure. This apparatus, compared with conventional spray cans, makes it possible to use either a reduced quantity of liquid gas or else compressed gases as the propelling force.

2. Description of the Prior Art

The ban on halogenated hydrocarbons, known under the names of FRIGEN or FREON, has led to the extensive use of hydrocarbons such as propane and butane, or dimethylether and mixtures of these. Both FRIGEN and FREON are hazardous for the ozone layer that surrounds the earth, and butane and propane, as well as dimethylether, are dangerous for the filling industry because of their explosive characteristics, as well as for the user, since deaths have been caused by the explosion of these substances.

In addition to these flammable gases, it is known that non-inflammable, only partially halogenated FREON 22 (chemical formula $CHClF_2$) can be used as a propellant. This can also be used in the USA and in the Scandinavian countries, where both FREON and FRIGEN are banned, because FREON 22 contains an additional hydrogen atom and, for this reason, is not as persistent as the fully-halogenated hydrocarbons. Since, however, the vapour pressure of the non-inflammable FREON 22 is extremely high and at 20° C. is approximately 9 bar, it must either be mixed with a gas with a lower vapour pressure, such as dimethylether or butane (which are flammable), or else used in reduced quantities, which is to say, between 18–50%-wt, depending on container quality. In particular, its use in glass vessels, without any plastic, for toilet preparations is problematic. This is because a pressure of 1.5 bar at 20° C. must not be exceeded but, depending on the content of water or ether oil, this pressure is reached at a FREON 22 content of 18%–20%. Since, however, the atomizing quality of conventional sprays depends to a great extent on the proportion of liquid gas, and thus on its expansion, the percentage of approximately 20% FREON 22 in place of the normal 50% FREON 114/12 is not sufficient to atomize toilet water such that the size of the droplets is so fine that the spray will be perceived as "not wet."

Metal cans are also subject to pressure limits imposed by law, so that here, too, one has to work with smaller quantities of FREON 22 that are smaller than those used in conventional spray cans.

The search for a solution for the problem described above has lead to a spray nozzle as described in European Patent No. 0000688, which produces extremely fine vaporization by purely mechanical means. In addition, apparatus have been developed as described in European Patent Nos. 0057226 and 0109361, and in PCT-application CH86/00103, published on Jan. 20, 1987 under the number WO87/00513, that permit the use of compressed air instead of liquid gas as the propellant, wherein, despite a diminishing propellant pressure, an almost constant ejection rate per unit time and a steady particle size are achieved.

Both the use of a reduced quantity of liquid gas, of only approximately 20%, or of compressed air, leads to difficulties. The aerosols that are commercially available all permit some leakage of the product after use, despite the fact that the valve has been closed. If such a valve is used with a high (normal) percentage of liquid gas, one cannot detect this leakage, because when in their liquid phase these gases simultaneously serve as solvents mixed with the active product. They are expelled in liquid form when the valve is opened which leads, when in contact with atmospheric pressure, to an explosion-like vaporization of both the liquid gas as well as of the product carrier, such as alcohol or water. If, however, one uses compressed gas such as air or nitrogen as the propellant, or if one uses a lower percentage of liquid gas, e.g. less than 25%, then this rapid-vaporization factor is either absent or else is so small that the violent vaporization that conceals the leakage or after-flow does not take place.

This leakage or after-flow can be attributed to several factors. In the so-called "male" valves, a plunger is provided with side holes which, when the valve is closed, lie within the substance of the rubber seal, so that no product can escape. Since, however, the central hole of the seal is stamped out, it has vertical grooves that are parallel to its axis, the depths of these varying as a function of the quality or amount of wear in the die, and through which the product can leak once the valve has been closed, until such time as the rubber creeps into the side holes of the plunger and closes them off. In so-called "female" valves, the valve is closed off by the annular rib of a plunger penetrating into a rubber gasket. The edge of most annular ribs is 0.4 to 0.5 mm wide, which means that, depending on the hardness of the rubber, the plunger will penetrate into the seal slowly, which can also lead to a leakage through such valves once they have been closed.

Depending on the quality of the valves, up to 0.03 ml can leak out each time the valve is opened. This leakage is not only messy; it can also lead to blockage of the vaporizer nozzles. In the case of hair spray, drying out of the film binders on the nozzle occurs, if the propellant force is generated by a lower percentage of liquid gas or compressed gas. The use of compressed gases or a lower proportion of liquid gas also causes other problems in that, because of a lack of pressure, not all the product can be expelled from the container.

In a spray can that is filled with liquid gas, the pressure is built up once again after every use by the continuing gasification of the liquid phase so that for all practical purposes there is a constant pressure in the can. At a lower percentage of liquid gas the quantity of gas is just sufficient to keep the pressure constant and to expel all the contents from the container. However, if one sprays for too long a period during one valve opening, this gasification leads to a cooling of the can, which then slows down the gasification, which means that not only does the pressure fall but more liquid gas than is intended is expelled and, for this reason there is insufficient to empty the can. Even if the can is used with the spray head underneath, the gas will be lost so that once again there will not be enough of it.

This problem is much more serious when compressed gas is used as a propellant because then the pressure cannot build up again. Depending on the position of the can, all the pressure can be completely lost, so that the remaining contents of the can, which can no longer be expelled, are wasted.

Despite the sealing that is used there can be a loss of pressure between the valve plate and the neck of the can. For example, if aluminum cans are produced by deep-drawing aluminum disks, grooves that are parallel to the axis of the can are formed in the outer wall of the can. Depending on the diameter of the can, these grooves can be between 0.02 and 0.08 mm deep, but are so narrow that the outer rubber seal cannot penetrate into them and thus cannot seal them off. Even though these grooves can be ground out or filled with a coat of lacquer, depending on the type of can that is involved, there is still a loss of pressure if the valve is not installed with the necessary precision.

A loss of pressure in compressed gases caused by holding the can incorrectly can be avoided by using a two-chamber system, in which the product is stored in a flexible inner container and the propellant, compressed gas, is stored in a rigid outer container. The latter acts on the flexible inner container and compresses this, which means that the product contained therein is expelled. Such systems are known. Their flexible inner containers must, however, be installed prior to the attachment of the base of the can or, in the case of monobloc cans, before the shoulder section is rolled. In addition, filling the cans with compressed gas is relatively complicated and demands a high level of precision, which is costly. In this regard, the base of the can may be provided with an opening which can be closed by means of a rubber stopper, the compressed gas is introduced into the can, whereupon the rubber plug is pressed completely into the opening, which it then seals hermetically. In addition to the necessary precision, this charging procedure takes up a great deal of time so that mass production becomes extremely costly.

Metal cans require many times the energy—both for the production of the metal as such and also for the producation of the cans— than is required to produce plastic, and cans of this material. Corrosion problems may also be encountered, depending on the type of metal that is used.

In order to avoid pressure losses caused by incorrect manipulation of the can when compressed gases are used there are valves on the market which, thanks to a ball, make it possible to spray the product even if the can is held upside down. However, such cans cannot prevent a loss of pressure if the can is held in an inclined position and the riser tube for the valve, because it is nearly always curved, is not in, but out of, the product.

SUMMARY OF THE INVENTION

The present invention solves the problems described heretofore and has as its object an apparatus for storing and for the controlled delivery of products that are under pressure, as defined in claim 1.

BRIEF DESCRIPTION OF THE DRAWINGS

The invention is described in greater detail below on the basis of advantageous, but not restrictive, embodiments shown in the drawings appended hereto. These drawings show the following:

FIG. 3: a cross section through a valve plunger;

FIG. 4: a plan view of the valve plunger FIG. 3;

FIG. 17: a cross section through a metal can with a greatly enlarged neck, with a metal valve plate;

FIG. 18: a cross section through the neck of a plastic can with a greatly enlarged can neck with a metal valve plate; and FIG. 19: a cross section through a valve unit for visose products such as oils, creams, pastes, gels, and the like.

DESCRIPTION OF THE PREFERRED EMBODIMENTS

Figure 1:
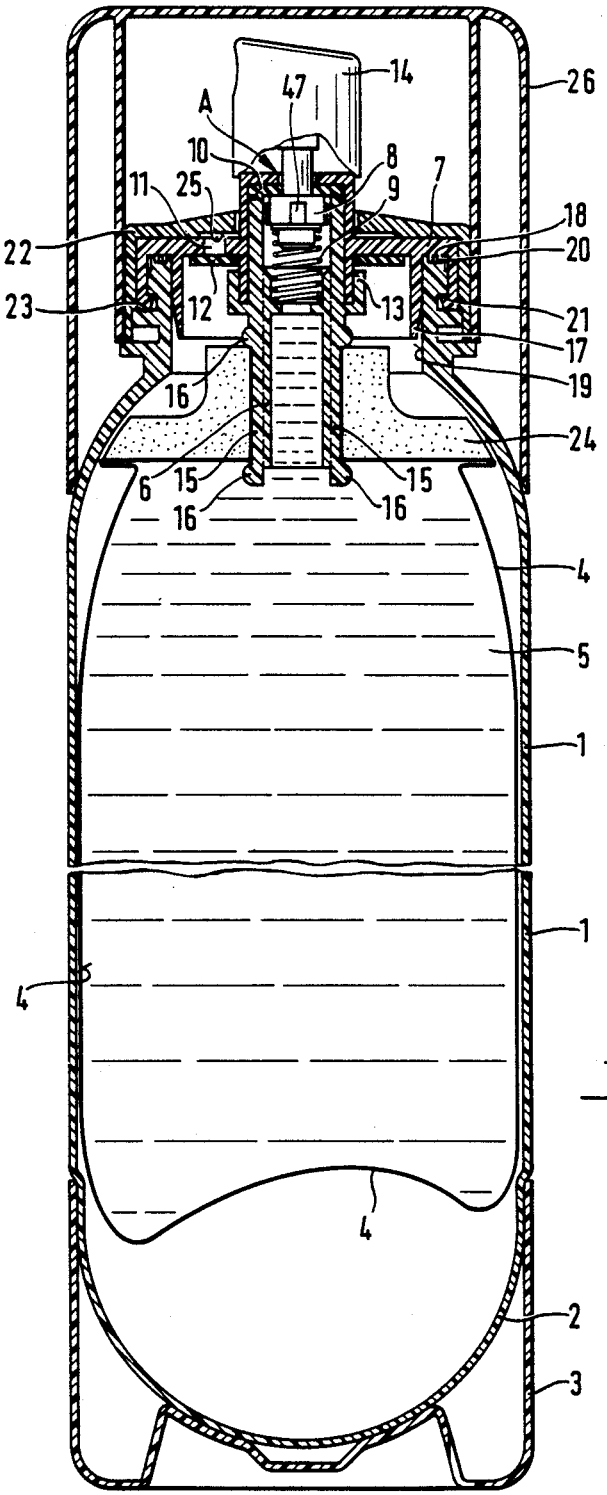
FIG. 1: a cross section through the object of the present invention, when filled.
Figure 2:
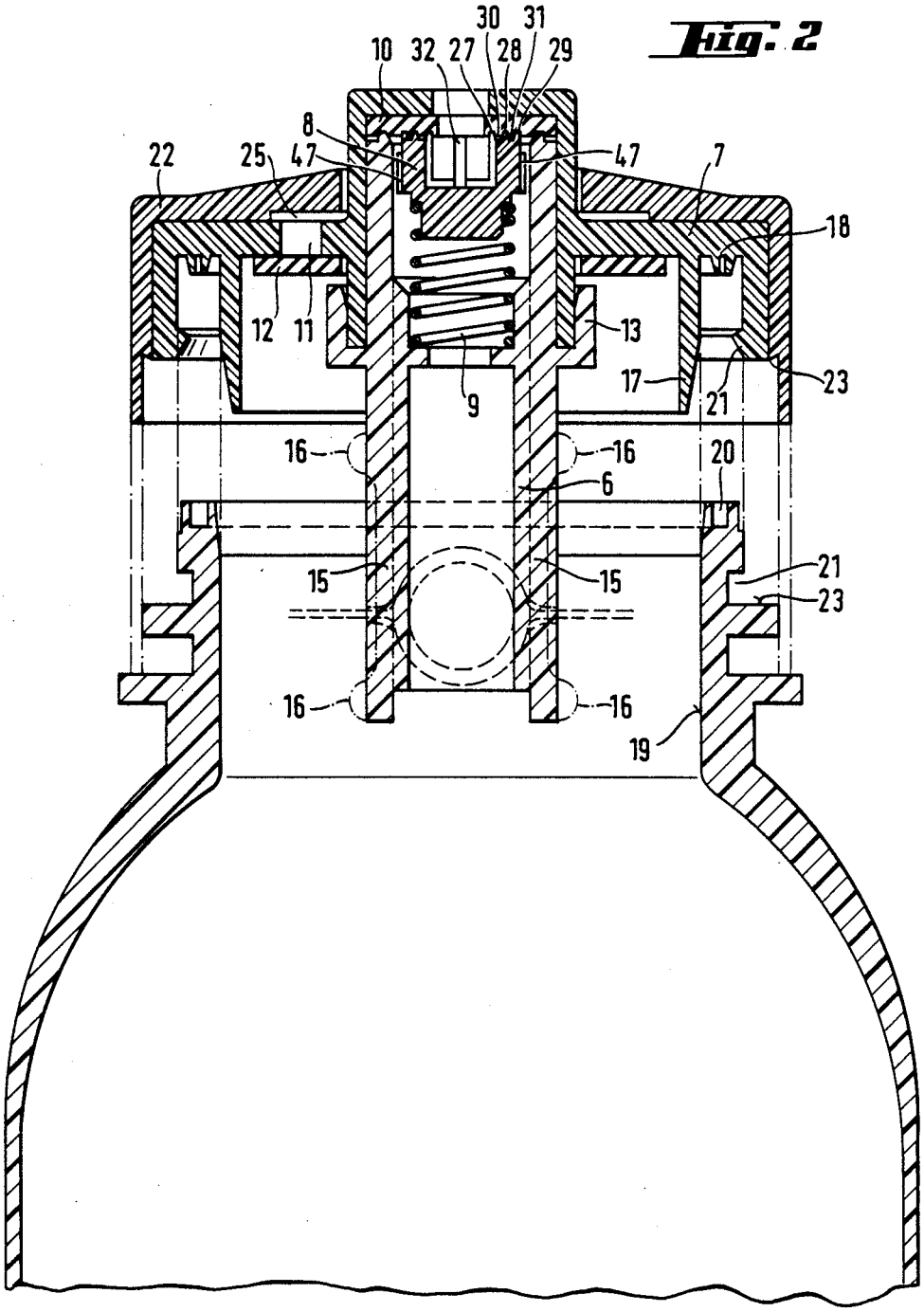
FIG. 2: a cross section through a valve unit before a bag is welded on and prior to its introduction into a plastic container.
Figure 16:
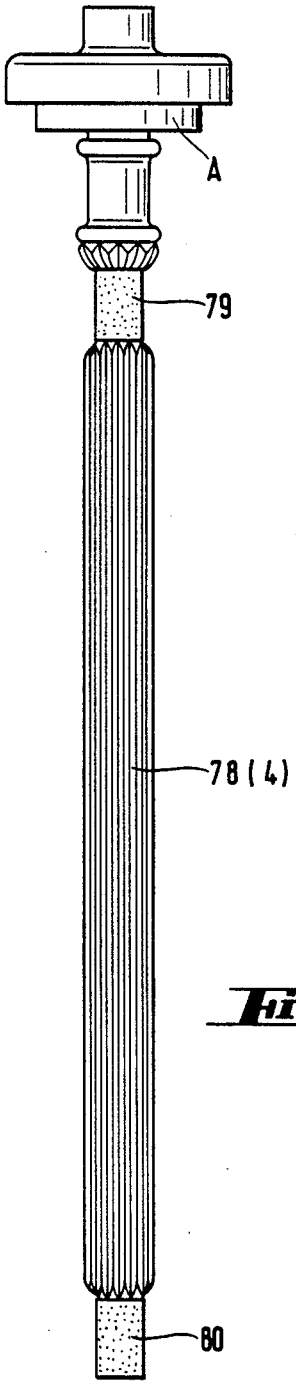
FIG. 16: a view of a valve unit supporting a folded bag.

FIG. 1 shows an apparatus according to the present invention. The container 1, in this instance preferably of PET (polyethylene terephthalate), has a hemispherical bottom 2 that is provided with a base cap 3 to enable it to stand upright. This container 1 contains the bag 4 in which the product 5 is stored. The bag 4 is welded onto the valve body 6 that is secured to the plastic valve plate 7, and contains the plunger 8, which is pressed hard against the rubber seal 10 by means of the spring 9 and penetrates partially into this seal. The plastic valve plate 7 is provided with a drilled hole 11 which, when the container 1 is under pressure, is closed by means of the rubber seal 12, this being held with the flange 13 of the valve body 6, if the container 1 is not yet under pressure. The plunger 8 supports the spray head 14. In order to seal the container 1 hermetically and thus avoid any loss of pressure, the plastic valve plate 7 is provided with an annular membrane 17 and the double annular rib 18, the ring membrane 17 closing the neck 19 of the can and the annular rib 18 closing the annular groove 20. When this is done, the annular membrane 17 and the annular rib 18 are drawn into their seats by means of the snap closure 21. The closing sleeve 22 prevents the snap closure 21 from opening and, because it is welded at 23 to the container 1, ensures that the latter is hermetically sealed. FIG. 2 shows these details at larger scale. As is explained in greater detail in conjunction with FIGS. 12 to 15, the valve body 6 is provided with side ribs 15 which form the bead 16 after the bag 4 has been welded on by means of the welded surface 24. The underside of the closing sleeve 22 has an annular groove 25 that prevents the drilled hole 11 from being covered over so that this drilled hole is not visible from the outside, although the container 1 can be pressurized through it from the outside, with the seal 12 then acting as a non-return valve. Finally, the apparatus according to the present invention is closed with the valve cap 26. The apparatus is assembled and charged as follows:

As is shown in FIG. 16, the valve unit A supports a folded bag 4 which is kept folded by means of a paper ring 79 at the valve end and a paper ring 80 at the opposite end. The thickness of the paper used in the rings 27 and 28 is so selected that when the bag 4 is filled they tear in the interior of the container 1, thereby ensuring that the bag 4 unfolds. The valve unit A with the folded bag 4, which behaves for all practical purposes like a "normal" riser tube and can be sorted by any commercial filling machine, is introduced into the container 1 by machine until the one part of the snap closure 21 snaps into the corresponding part of the neck 19 of the can, whereupon the closing sleeve 22 is welded onto the neck 19 of the can at the level 23, this also being done by machine. This prevents the snap closure 21 from releasing. It also ensures that the closing sleeve 22 (which is of the same material as the neck 19 of the can) is joined homogenously with the neck, due to the use of ultrasound welding, and thus provides a perfect seal for the apparatus according to the present invention. There is also a further seal that results from the fact that the annular membrane 17 is locked into the neck 19 of the can and the double annular rib 18 is locked into the annular groove 20. This method of sealing is important in order to avoid any loss of compressed air, which could lead to the fact that, because of a lack of propellant force, not all of the product 5 can be driven out of the container 1. Prior to the installation of the spray head 14 or of another dispensing element, the bag 4 is filled with the product 5 through the valve body 6 by forcing the plunger 8 away from the seal 10. Once this has been done and a special filler head has been installed on the closing sleeve 22, compressed air is introduced into the container 1 through the drilled hole 11 in the valve plate 7, which then places the product contained in the bag 4 under pressure. After installation of the spray head 14 or, depending on the properties of the product, of another dispensing element, the apparatus according to the present invention is ready for use. Finally, it is closed by means of the valve cap 26.

The leakage of product from the valve once said valve has been closed, discussed heretofore, is eliminated because of the plunger 8 according to the present invention. This plunger is provided with the annular ribs 27, 28, and 29, which result in the annular grooves 30 and 31. As is shown in FIG. 3, the annular ribs 27, 28, and 29 penetrate the seal 10, which means that this is forced into the annular grooves 30 and 31, which results in the immediate closing of the valve unit A.

If the valve unit A is used with compressed air as the propellant, it will require a greater cross section and a plurality of flow channels 32 and 33, as is shown in FIG. 4, in order to ensure the greatest possible thrust, especially after a reduction of pressure.

Figure 5:
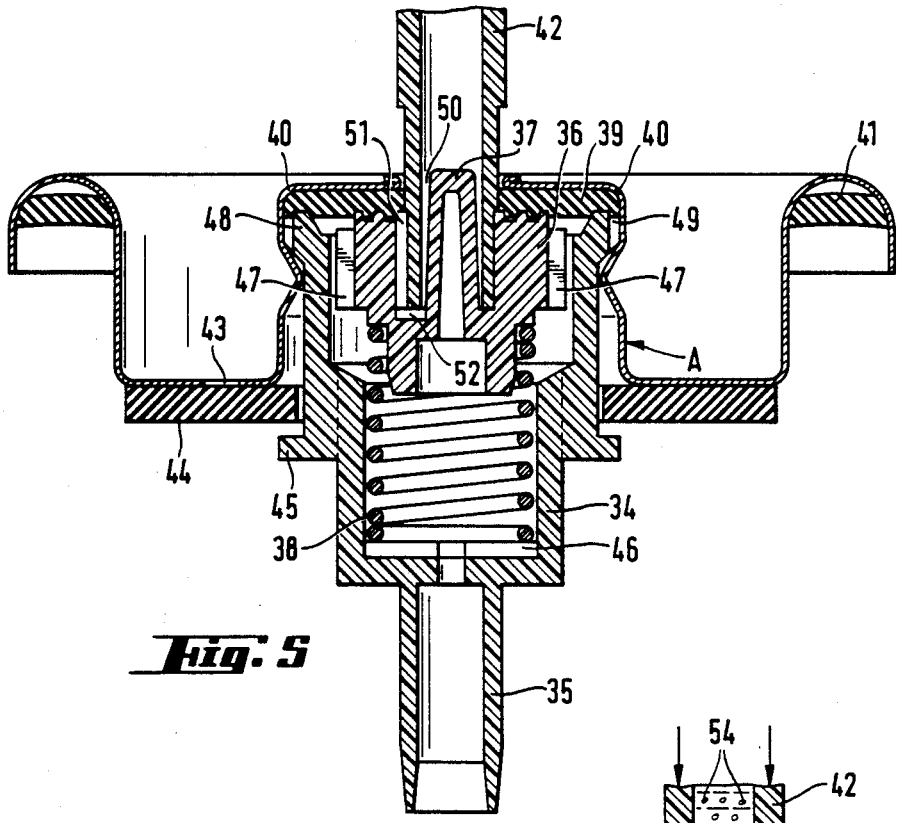
FIG. 5: a cross section through a closed valve.
Figure 6:
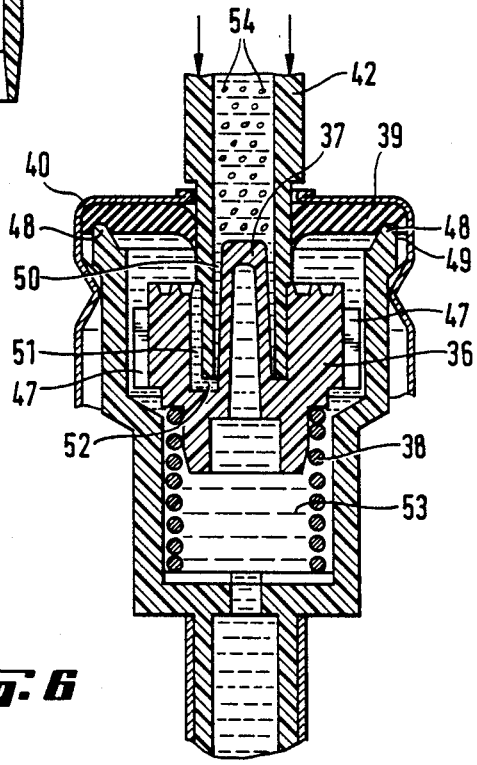
FIG. 6: a cross section through the valve of FIG. 5 is opened positioned.

A version as is shown in FIGS. 5 and 6 will be required in order to use the valve according to the present invention for aerosol cans that use liquid gases, the percentage of which has had to be reduced because of excessively high vapour pressure, or the quantity of which is to be reduced for reasons of safety, which means that there will be some leakage once the valve has been closed, as has been described above. The valve unit A according to the present invention consists of the valve body 34 that is provided with the riser tube holder 35, the plunger 36 with the pin 37, the spring 38, the inner seal 39, the valve plate 40 with the container seal 41, and the plunger tube 42. The valve plate 40 is provided with the drilled hole 43 which, when a container that is closed by means of the valve unit A is under pressure, is sealed off by means of the sealing washer 44 that is held with the flange 45. The base of the valve body 34 is provided with the ribs 46 on which the spring 38 lies. By this means, the product that enters the valve body beneath the spring 38 can move between the ribs 46 in the direction of the seal 39. The plunger 36 supports the spring 38. This has guide ribs 47 and is shown with ribs and grooves at a greater scale in FIG. 3. The edge 48 of the valve body 34 is provided with vertical grooves 49 which permit gasification of a container that is closed off with the valve unit A, between the valve plate 40 and the seal 39, without the valve being opened. The base diameter of the pin 37 is somewhat smaller than the inside diameter of the plunger tube 42 so that a gap 50 results. Parallel to the pin 37 there is a groove 51 that opens out into the groove 52 that is perpendicular to it. Thus, when the valve is open, a product can only escape through the grooves 51 and 52, and the gap 50. Since these passages are of a specific cross section, the valve according to the present invention provides a calibrated expelled quantity per unit time, and does this regardless of the distance moved by the plunger 36.

The use of a smaller percentage of liquid gas, e.g., FREON 22, leads to an expulsion pressure of 1.5 bar at 20° C. Despite the use of a spray nozzle, described in European Patent No. 0000688, which has a very great mechanical break-up effect, the quality of the atomization is still too wet, despite the presence of a liquid gas fraction in the product that is expelled, because this liquid gas fraction is too low for the explosion-like atomization that has been described hertofore. Using the valve according to the present invention, it is now possible to achieve a "drier" atomization.

It is known that liquid gas remains liquid under a specific pressure that acts on it and only turns into gas if this pressure is reduced, for example, when a container is emptied. It is also known that one can also accelerate a product that is under pressure by using a smaller flow cross section and thereby reduce its pressure, which means that, depending on the acceleration of the product, its pressure will fall below that pressure that keeps the gas liquid, so that it can turn into gas as a result of this acceleration.

This is shown in FIG. 6. If one presses on the plunger tube 42, the plunger 36 moves away from the seal 39, which means that the product 53 that is under pressure can move through the grooves 51 and 52 into the gap 50. Since the cross section of the gap 50 is such that the product flowing there is accelerated, it loses pressure and part of the liquid fraction can turn into gas, as is represented by the bubbles 53. Thus, a mixture of active product (alcohol, perfume, etc.), liquid gas, and actual gas moves into the spray nozzle, which then atomizes the active product mechanically whereupon the explosion-like evaporation of the liquid gas fraction, supported by the gas fraction (bubbles 54) so enhances this mechanical atomization that the drops are so small that a very rapid evaporation takes place and the spray is perceived as not "wet."

Normally, the liquid gas is introduced into the aerosol container through the valve when one opens the valve by machine, always provided that one has a special gasification system, which introduces the liquid gas between the valve plate 40 and the seal 39 through the grooves 49 into the can, as has already been described. Since the valve according to the present invention must have a very small flow cross section in order to fulfill its function as described, charging the can with gas requires a great deal of time, which is undesirable from the point of view of mass production. However, charging can take place very rapidly because of the drilled hole 43 and the seal 44.

As has been described in the introduction hereto, there are various two-chamber cans available commercially, in which the product is stored in a flexible inner container which is then compressed either by liquid gas in a rigid container or by compressed gas such as air or nitrogen, so that the product contained in the flexible container is expelled when the valve is opened.

If, when a liquid gas is used, it is important that this does not come into contact with the product, and, at the same time, a constant pressure must be available, the use of compressed gas will then make it necessary to avoid any loss of pressure. Since, however, the commercially available flexible containers are costly, it is necessary to find a less expensive solution.

Figure 7:
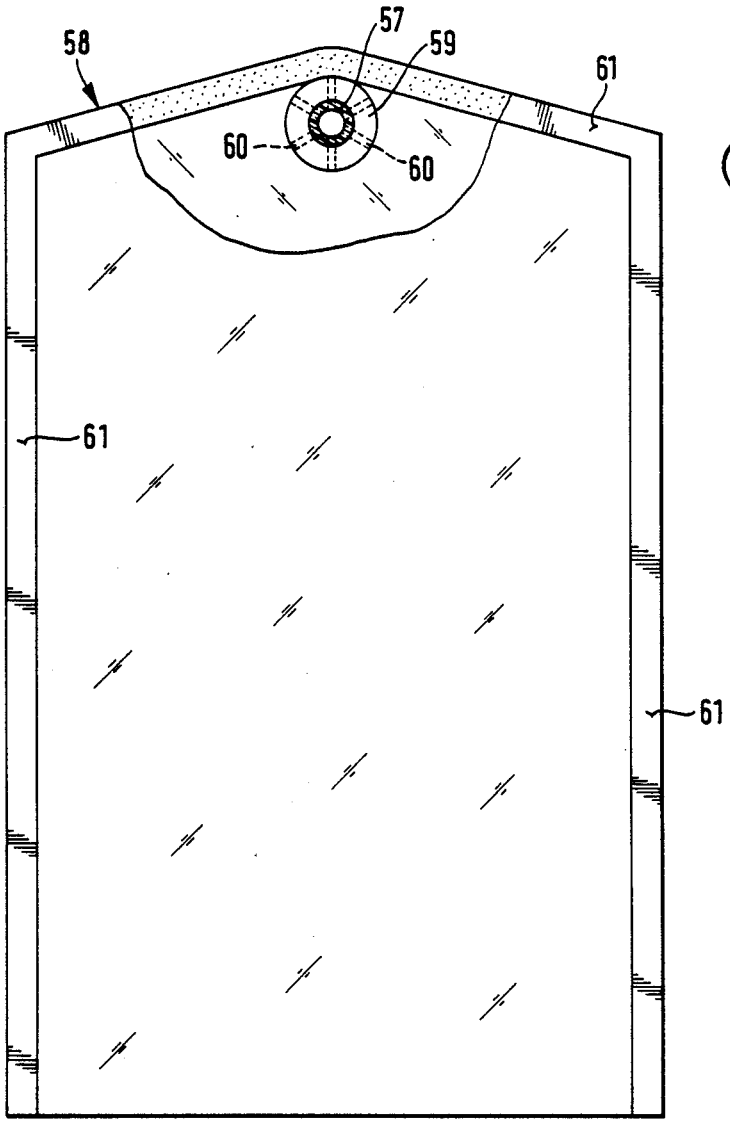
FIG. 7: a view of an embodiment of a welded bag prior to said bag being filled.
Figure 8:
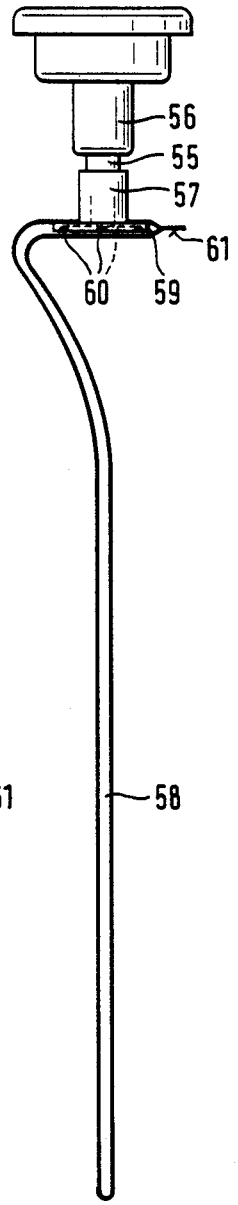
FIG. 8: a side view of the bag of FIG. 7 when secured to a valve.

FIGS. 7 and 8 show such a solution. The nipple 57 of the bag 58 is secured to the bag carrier 55 of the valve body 56, and is prevented from separating from this by means of a snap closure (not shown herein). The nipple 57 is provided with the disk 59 that has radial grooves 60. This is of the same plastic material, for example, polyethylene or polypropylene, as the inner side of the foil that is intended to be welded together, so that the disk 59 can be welded to the foil material. The bag 58 can be of a compound foil in which an aluminum foil is bonded between two plastic foils so that at an aluminum-foil thickness of 0.012 mm any migration of odour or atmospheric oxygen is avoided. This solution is applied mainly when the bag 58 is used to store perfume, foodstuffs, or medications, in which this migration, as described above, is to be avoided. In order to produce the bag, one uses a plastic foil with a hole through which the nipple 57 passes from that side of the foil intended as the inside, so that the disk 59 can be welded to it since it is of the same material as the inside of the bag. Then, the foil is folded and heat is used to produce the welded surface 61, so that a bag results.

Figure 9:
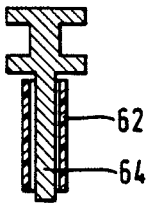
FIG. 9: a cross section through a metal core installed in a plastic tube, prior to the welding of a bag.
Figure 10:
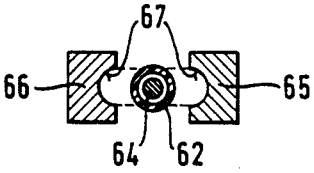
FIG. 10: a cross section through the metal core of FIG. 9, installed between two welding blocks.
Figure 11:
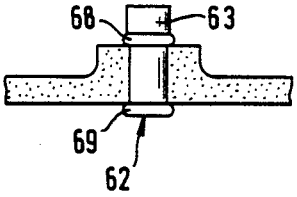
FIG. 11: a view of a bag after being welded onto the plastic tube as in FIGS. 9 and 10.
Figure 12:
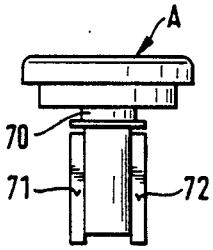
FIG. 12: a view of a valve in which the valve body is provided for direct welding of a bag.
Figure 13:
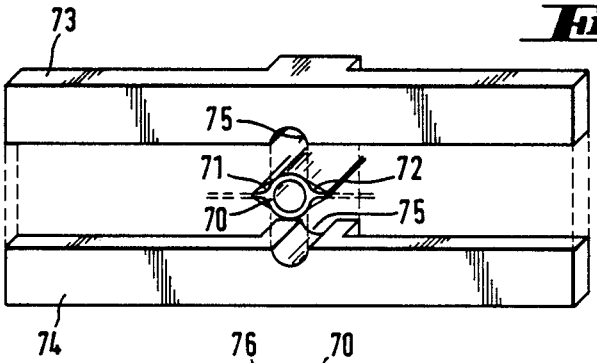
FIG. 13: a perspective view of the valve body as shown in FIG. 12, between two welding blocks.
Figure 14:
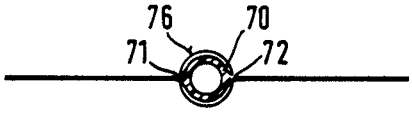
FIG. 14: a plan view of a bag after being welded onto the valve body of FIG. 12.
Figure 15:
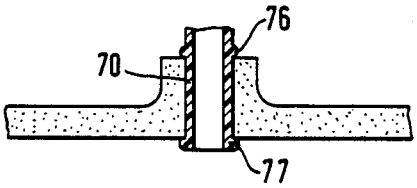
FIG. 15: a partial view of a bag after being welded onto the valve body of FIG. 12.

FIGS. 9, 10, and 11 show another embodiment of the bag according to the present invention. This involves a section of tube 62 which on the one hand facilitates the welding of the foil of the same material and, on the other, becomes a nipple 63 that is installed on a valve (not shown herein) as described above. If one wishes to heat weld two foils on one piece of tube, longitudinal channels will be formed along the point of contact of the foils on the section of tube 62, which will mean that a bag produced in this manner is not leak-proof. This problem can be solved as follows: the wall thickness of the section of tube 62 should amount to a minimum of 1 mm. A metal core 64 is inserted into the section of tube 62, the diameter of this being smaller than the inside diameter of the tube section 62. Once the prepared section of tube 62 has been installed between two plastic foils, these are then clamped together with two welding blocks 65 and 66, each of which has a semicircular groove 67, the diameter of which is smaller than the outside diameter of the section of tube 62. Under the heat of the welding blocks 65 and 66, the plastic material of the inner wall of the plastic foil and the section of tube becomes liquid and is deformed into beads 68 and 69, and the remainder of the section of tube 62 lies against the metal core 64 so that the foils are bonded homogenously with the section of tubes 62, and the longitudinal channels described above are avoided.

If, however, one wishes to install the bag directly onto a valve unit A, as is shown in FIGS. 12, 13, 14, and 15, then a metal core 64 is not used. In order to avoid the longitudinal channels described above, the valve body 70 is provided with side vanes 71 and 72. Once the valve body 70 has been installed between two plastic foils, these are clamped between two welding blocks 73 and 74, each of which has a semicircular groove 75, the diameters of which are smaller than the outside diameter of the valve body 70. Under the heat of the welding blocks, the valve body 70 becomes so deformed that the side vanes 71 and 72 flow between the foils and there avoid the above-described longitudinal channels. When this is done, the beads 76 and 77 are formed, which additionally improve the sealing of the bag. This solution is extremely advantageous since, on the one hand, it avoids the process of installing the bag on a valve unit A and, on the other, ensures a greater bag length, so that the bag has a greater filled volume.

These solutions for the use of a welded, very flexible bag entail the advantage that they can be sorted by existing aerosol filling machines and can be installed in the cans in the normal manner without the need for any modifications to the machines used for this process. FIG. 16 shows a bag 78 according to the present invention that is folded into accordion folds and welded to the valve unit A, with the bag 78 having the paper ring 79 at the level of the valve and the paper ring 80 at the opposite end, these preventing the bag 78 from unfolding, so that the bag 78 remains as rigid as a normal riser tube and, although over-dimensioned, can be introduced into commercially available cans. The thickness of the paper ring is so selected that these rings can stand up to being moved and sorted but tear when the bag 78 is filled when accommodated inside the can, so that the bag 78 can unfold completely. This solution entails the added advantage that when the bag is folded this forms buckles or kinks that result in fine vertical grooves that remain even after the bag is unfolded and prevent the two welded foils collapsing at the level of the valve once a specific quantity of product has been expelled, which would mean that no further product can be expelled from the can.

The use of compressed gas as propellant leads to another problem that has been described heretofore. The installation and attachment of a valve plate on the neck of the can requires a very high level of precision which, however, is frequently not enough to prevent a leak between the neck 81 of the can and the valve unit A when compressed gas is used, as has been shown by tests. Cans 82, FIG. 17, which have a milled annular groove on the edge of the neck 81 of the can in which a rubber seal is installed, are commercially available. Experience has shown that this does not represent an absolute solution to the problem. According to experience, this problem has been solved in that the neck of the can 81 has two annular grooves 83 and 84 that are not on the edge but are at an angle to this, towards the outside, which forms a plurality of corners 85 that penetrate into the rubber seal, so that the rubber seal is forced into the annular grooves 83 and 84 thereby ensuring a reliable seal even if there is a lack of absolute precision.

FIG. 18 shows the neck of a plastic can 87 that has a series of annular steps 88 and 89, so that corners 90 result, these penetrating into the rubber seal 92 when the valve plate 91 is rolled on, thereby ensuring a reliable, leak-free closure of the can 87.

Figure 19:
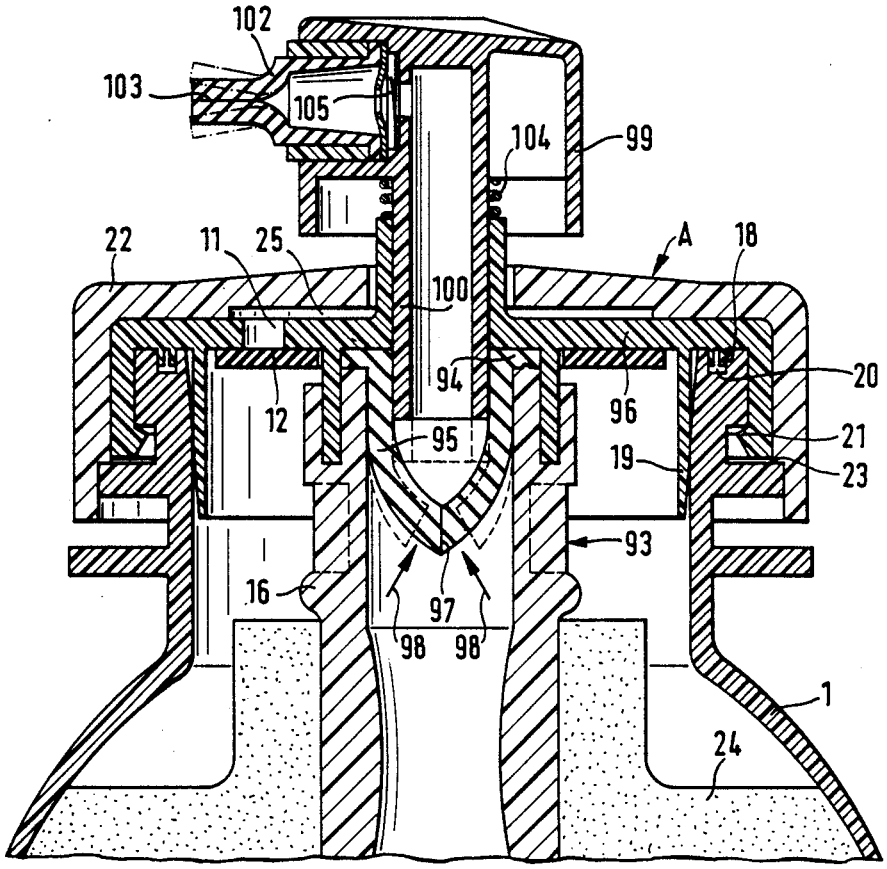

FIG. 19 shows a valve unit A which is used especially for dispensing viscose products. The valve body 93 forces a seal 94 of elastic material which has an ogival button that is directed downwards into the valve plate 96. The button 95 has a cut 97 that is closed by the pressure represented by the arrows 98. The dispenser head 99 is fitted with the section of tube 100 that is inserted into the button 95 and supports the diffuser 102, which is also of elastic material. If one moves the dispenser head 99 downwards, the cut 97 in the button 95 and the cut 103 in the diffuser 102 open, as is indicated by the dashed lines, so that the product can be expelled. If one then releases the dispenser head, the pressure indicated by the arrows 98 forces the cut 97 closed, and, because the button 95 is of elastic material, this acts as a spring, and forces the section of pipe 100 back into its starting position. It is also possible to use a metal spring 104 for this purpose. The cut 103 in the diffuser 102 is opened because of the opening of the cut 97 and the ejection of the product that is made possible by this, and this closes if the product expulsion pressure drops, so that any product located in the dispenser head 99 is protected from outside air and cannot dry out. A control disk 105 as described in patent number DD250 694 A5 (German Democratic Republic) is installed in the dispenser head 99 which, despite a reduction in pressure when compressed gas is used, ensures an almost constant quantity is expelled per unit time. When liquid gases that compress the flexible bag are used, the use of a regulator disk 105 is also advantageous, because changes in temperature can lead to large variations in pressure and thus to changes in the quantities of product expelled per unit time.

The above-described apparatus, shown in the illustrations, are non-restrictive embodiments of the invention.

I claim:

1. An apparatus for the storage and controlled issue of products that are under pressure of a propellant, comprising:

a rigid outer container having a neck, said neck defining an opening into said outer container;

a flexible inner container hermetically secured to a valve unit, said valve unit including a passageway for fluid communication with the interior of said inner container, said passageway having sealing means, disposed therein, for controlling fluid flow therethrough, said sealing means being movable between a first position wherein fluid flow through said passageway is prevented and a second position wherein fluid flow through said passageway is permitted, said sealing means being yieldably urged to said first position;

a valve plate, hermetically sealed to said valve unit, for hermetically sealing said neck of said outer container;

an aperture formed in said valve plate, said aperture defining a fluid passageway into the interior of said outer container;

closure means for hermetically closing said aperture when the interior of said outer container is under pressure;

a dispenser head for dispensing said product under propellant pressure;

tube means for fluidically connecting said dispenser head and said valve unit, said tube means being slidably received in said passageway of said valve unit, said tube means being movable in response to manual pressure on said dispenser head from a first position wherein said tube means is in contact with said sealing means in said first position to a second position wherein said tube means holds said sealing means in said second position of said sealing means, said tube means returning to its first position upon release of manual pressure on said dispenser head by reason of the return of said sealing means to said first position of said sealing means.

2. The apparatus according to claim 1, wherein said dispenser head comprises a spray nozzle.

3. The apparatus according to claim 1, wherein said neck of said can is provided with a series of steps sealingly engageable with said valve plate.

4. The apparatus according to claim 1, wherein said flexible inner container comprises a bag, a nipple passing through said bag, said nipple having a flange formed at one end thereof, said flange having a first face adjacent said one end and a second face remote from said one end, said first face having grooves formed therein, said second face hermetically sealed to an inner wall of said bag, said nipple being sealingly connected to said valve unit.

5. The apparatus according to claim 1, wherein said valve unit and an inner wall of said flexible inner container are formed of polypropylene.

6. The apparatus according to claim 1, wherein said flexible inner container is formed as a bag folded in accordion folds along a longitudinal axis, paper rings being provided to hold said bag in said folded shape until said bag is filled with product, said paper rings being tearable upon receipt of product within said folded bag with concomitant expansion of said bag.

7. The apparatus according to claim 1, wherein said dispenser head comprises a diffuser.

8. The apparatus according to claim 7, wherein said propellant is a compressed gas and said dispenser further comprises a regulator for regulating the quantity of product that is expelled.

9. The apparatus according to claim 1, wherein said valve unit is formed of a plastic and an inner wall of said flexible inner container is formed of said plastic, said valve unit having vanes, said flexible inner container hermetically secured to said valve unit by heat sealing of said inner wall of said flexible inner container to said vanes.

10. The apparatus according to claim 9, wherein said flexible inner container comprises a folded plastic foil having thermal welded seams.

11. The apparatus according to claim 1, wherein said neck of said can is provided with at least one groove sealingly engageable with said valve plate.

12. The apparatus according to claim 11, wherein said outer container is formed of plastic and said valve plate is formed of plastic; said neck of said outer container having a snap closure element formed thereon, said valve plate having a snap closure counterpart element formed thereon engageable of said snap closure element on said neck; said valve plate having an annular membrane enagageable of the interior of said neck; said valve plate having a double annular rib engageable of said at least one groove.

13. The apparatus according to claim 12, wherein a plastic closure sleeve is welded to an annular rib formed on the neck of said outer container, said closure sleeve preventing said snap closure of said valve plate and said neck from opening.

14. The apparatus according to claim 1, wherein said sealing means comprises a valve plunger sealingly engageable of said valve unit in a first position and disengaged from said valve unit in a second position, said valve plunger having at least two annular ribs engaging said valve unit when said valve plunger is in said first position.

15. The apparatus according to claim 14, wherein said tube means comprises a hollow tube engaging said valve plunger, said valve plunger having at least one horizontal flow channel and at least one vertical flow channel for fluidically interconnecting said hollow tube and said passageway when said valve plunger is in said second position.

16. The apparatus according to claim 15, wherein said valve plunger is provided with four vertical channels and four horizontal channels.

17. The apparatus according to claim 15, wherein said valve plunger is provided with a pin, receivable within said hollow tube, said hollow tube having an inner diameter greater than a base diameter of said pin.

* * * * *